US011932998B2

(12) United States Patent
Harmeling et al.

(10) Patent No.: US 11,932,998 B2
(45) Date of Patent: Mar. 19, 2024

(54) INFILL MIXTURE FOR ARTIFICIAL TURF

(71) Applicant: Ten Cate Thiolon B.V., Nijverdal (NL)

(72) Inventors: Francesco Antonius Lodewijk Harmeling, Nijverdal (NL); Bart Wijers, Nijverdal (NL); Frederik Jan van der Gaag, Nijverdal (NL)

(73) Assignee: Ten Cate Thiolon B.V., Nijverdal (NL)

( * ) Notice: Subject to any disclaimer, the term of this patent is extended or adjusted under 35 U.S.C. 154(b) by 557 days.

(21) Appl. No.: 16/628,686

(22) PCT Filed: Jul. 5, 2018

(86) PCT No.: PCT/NL2018/050441

§ 371 (c)(1),
(2) Date: Jan. 6, 2020

(87) PCT Pub. No.: WO2019/009718

PCT Pub. Date: Jan. 10, 2019

(65) Prior Publication Data

US 2020/0224374 A1 Jul. 16, 2020

(30) Foreign Application Priority Data

Jul. 5, 2017 (NL) ..... 2019187

(51) Int. Cl.
*E01C 13/08* (2006.01)

(52) U.S. Cl.
CPC ..... *E01C 13/08* (2013.01)

(58) Field of Classification Search
CPC .. E01C 13/08; E01C 13/083; E01C 2013/086; D10B 2505/202
See application file for complete search history.

(56) References Cited

U.S. PATENT DOCUMENTS

| | | | | |
|---|---|---|---|---|
| 4,337,283 | A | 6/1982 | Haas, Jr. | |
| 6,472,041 | B1 * | 10/2002 | Burke | B32B 27/32 428/17 |
| 9,157,196 | B2 * | 10/2015 | McSwain | E01C 9/00 |
| 2004/0058095 | A1 * | 3/2004 | Carr | B64F 1/025 428/17 |
| 2005/0042394 | A1 * | 2/2005 | Sawyer | E01C 13/08 428/17 |
| 2007/0248773 | A1 * | 10/2007 | Nusca | E01C 13/08 428/22 |

(Continued)

FOREIGN PATENT DOCUMENTS

| | | | |
|---|---|---|---|
| JP | 2004036264 | A | 2/2004 |
| JP | 2015108248 | A | 6/2015 |

(Continued)

OTHER PUBLICATIONS

Moriishi et al.; Machine translation JP 2015108248 A; Jun. 2015; All; (Year: 2015).*

(Continued)

*Primary Examiner* — Benjamin F Fiorello

(74) *Attorney, Agent, or Firm* — N.V. Nederlandsch Octrooibureau

(57) ABSTRACT

A cork-based infill mixture for an artificial turf system, wherein the infill mixture comprises a predominance of cork particulates and a quantity of smooth, hard granules interspersed between the particulates.

18 Claims, 1 Drawing Sheet

(56) References Cited

U.S. PATENT DOCUMENTS

| | | | | |
|---|---|---|---|---|
| 2010/0055461 | A1* | 3/2010 | Daluise | E01C 13/08 428/403 |
| 2010/0166984 | A1* | 7/2010 | Nusca | E01C 13/08 428/17 |
| 2012/0189786 | A1* | 7/2012 | Nusca | B05D 1/36 427/415 |
| 2015/0308056 | A1 | 10/2015 | Spittle et al. | |
| 2017/0058464 | A1* | 3/2017 | Smollett | D05C 17/02 |
| 2017/0067213 | A1* | 3/2017 | Sarris | D04B 21/16 |

FOREIGN PATENT DOCUMENTS

| | | |
|---|---|---|
| WO | 0198589 | 12/2001 |
| WO | 2006092337 | 9/2006 |
| WO | 2016190744 | 12/2016 |

OTHER PUBLICATIONS

Koga, Matsuki; Machine Translation JP 2004036264 A; Feb. 2004; All (Year: 2004).*
Krumbein; Sphericity Chart; 1975 (Year: 1975).*
Polymer Technologies; Open vs. Closed Cell Foam; 2018 (Year: 2018).*

* cited by examiner

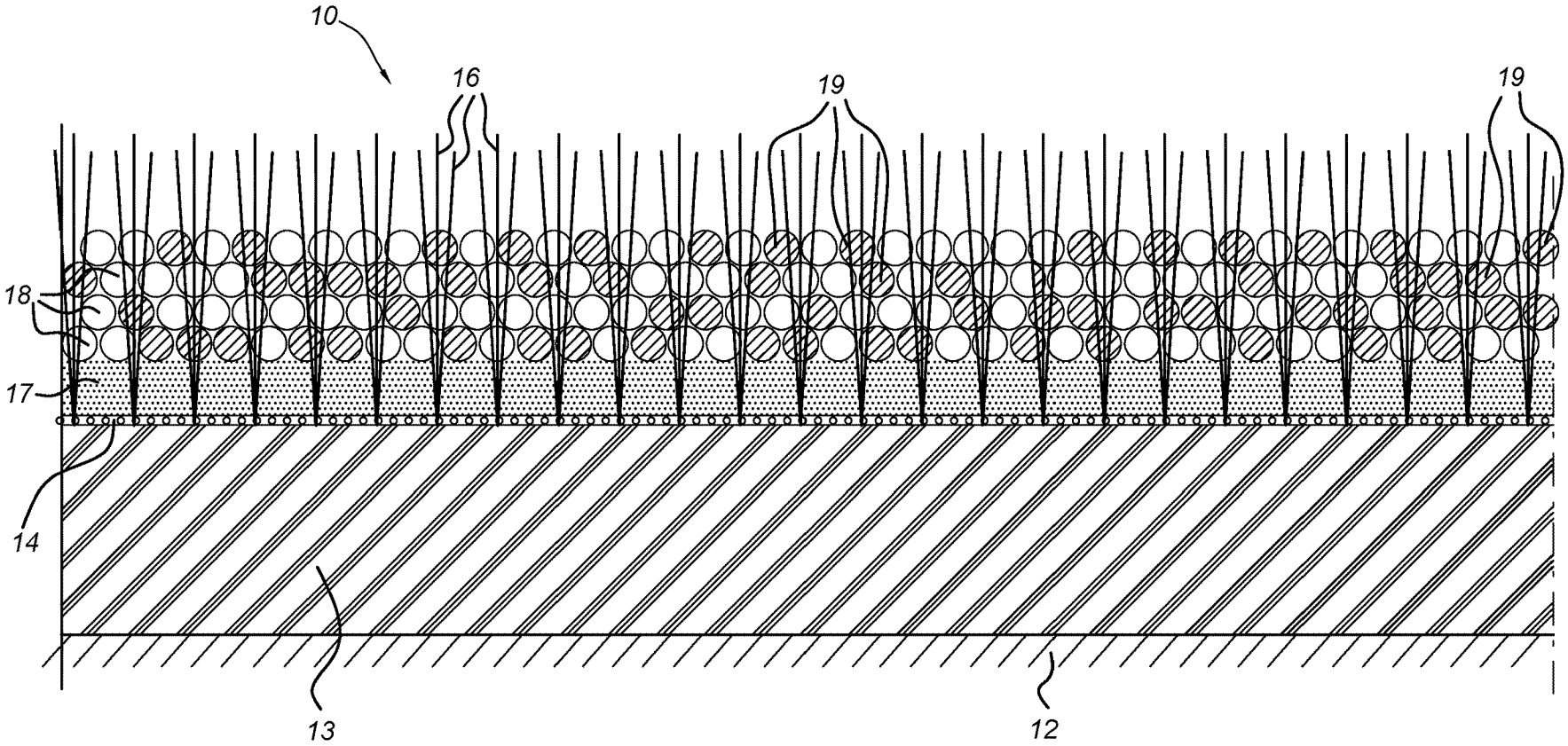
10
16
19
19
18
17
14
13
12

INFILL MIXTURE FOR ARTIFICIAL TURF

BACKGROUND OF THE INVENTION

1. Field of the Invention

The present invention relates to infill mixtures for artificial turf systems, in particular to cork-based infill mixtures. The invention also relates to artificial turf systems and to the use of granules and infill mixtures for artificial turf systems.

2. Description of the Related Art

Artificial turf systems are well known for various sporting and aesthetic purposes and have developed through a number of generations to their present form. In general, such systems seek to achieve the same characteristics as their natural counterparts although in certain areas these may have already been surpassed, at least in terms of predictability of behaviour.

Typical third generation turf systems comprise a backing layer with an upper surface and an infill layer of soft particulates disposed between the fibres. The backing layer may consist of a woven fabric in which artificial grass fibres are tufted to provide pile fibres oriented in an upward position and fixed to the woven fabric by a backing layer of latex or polyurethane. Alternatively, the backing and the pile fibres can be produced simultaneously by weaving the carpet. Here there is considerable freedom for the position of the pile fibres and the backing structure.

Installation of the turf system typically involves providing a layer of loose sand, strewn between the upstanding turf fibres, which by its weight holds the backing in place and supports the pile in upward position. Onto this sand layer and also between the artificial turf fibres, soft elastomeric granules are strewn, forming a loose performance infill layer that provides the necessary sport performance. These performance characteristics will depend on the intended use but for most sports will include: rotational and linear grip; force reduction; vertical ball bounce; and rotational friction. This performance can be further supported by applying a shock pad or e-layer directly under the backing layer. In some cases, the sand layer may be omitted. One system of this type has been described in UK patent application GB2429171.

Recently, there has been increasing attention to natural alternatives to regular infill materials, such as SBR or other rubbers. These natural alternatives include cork, coconut fibres, husks and the like. Cork is favoured because of its good flexibility and sport performance and one of the best consistency amongst natural infill materials. Artificial turf systems also need to be kept moist. This has a cooling effect, but also improves the playing characteristics and the sliding performance. This requires regular spraying or flooding with water. Once wetted, cork is especially good at retaining water. However, compared to elastomeric infill materials, it suffers heavily from compaction. During an extended period of use, the layer of cork particulates can evolve into a solid layer, instead of maintaining its particle-like structure. As a result, sport-shoe studs are hindered in entering the layer and ball bounce properties change, which degrades the playing performance. Similar effects may be found with other natural alternative infill materials. Even with regular maintenance, natural materials have been found to deteriorate unacceptably with time due to such compaction. It would be desirable to provide an infill material which suffers less from compaction.

BRIEF SUMMARY OF THE INVENTION

The invention relates to a cork-based infill mixture for an artificial turf system, wherein the infill mixture comprises a predominance of cork particulates, and a quantity of smooth, hard granules interspersed between the particulates.

In this context, reference to particulates refers to the cork, and reference to granules refers to the non-cork material, as specified below. Furthermore, reference to cork is intended to include other similar natural infill materials such as coconut fibre and husks and mixtures of the same.

The infill mixture of the invention combines good water retention, shock absorption and particle mobility, which can be used in an infill layer that does not compact under normal use.

The smooth, hard granules that are added are very mobile. Without wishing to be bound by theory it is believed that they counteract the compaction of the cork, while simultaneously the cork limits the mobility of the smooth, hard granules. Together this results in an infill layer which suffers very little from compaction but still has enough grip. In fact, the granules appear to act as ball-bearings, improving the mobility of the cork particulates and avoiding compaction as much as possible.

According to the invention, the granules are smooth. The skilled person will be aware that smoothness may be defined in a number of ways but for the sake of the present invention is defined as requiring a relatively low coefficient of friction. The granules may have a surface for which the frictional coefficient is less than 0.5. The frictional coefficient in this case is the static frictional coefficient measured for two surfaces of the same material in contact according to ASTM G115-10(2013).

Cork has the advantage that it is a natural material, where the granules hold the water very well, such that the artificial turf stays moist for a long time after sprinkling. The cork typically has a bulk density of about 0.15 kg/litre although this may vary according to the particle size and cork type.

According to an embodiment, the cork particulates have typical sizes of between 0.5 mm and 3 mm, preferably between 1.0 mm and 2.0 mm and more preferably between 1.2 mm and 1.5 mm. According to a further embodiment, the cork particulates have irregular and in particular angular shapes.

According to an embodiment, the infill mixture comprises between 70 vol % and 50 vol % of cork particulates and between 30 vol % and 49 vol % respectively of smooth, hard granules. More preferably the infill mixture comprises about 60 vol % of cork particulates and about 40 vol % of smooth, hard granules. In this context, the volumetric percentages indicate the percentages of granules and soft infill particulates used to constitute the mixture, and are defined prior to mixing.

According to an embodiment, the granules should have a substantially spherical shape. Preferably they have a sphericity greater than 0.5 or greater than 0.7 or even greater than 0.9, wherein sphericity is defined as the ratio of the diameter of a sphere of equal volume to the granule to the diameter of the circumscribing sphere.

The granules may have roundness values of greater than 0.5 or greater than 0.7 or even greater than 0.9, wherein roundness is defined as the ratio of the average radius of curvature of the corners and edges of the granule to the radius of the maximum sphere that can be circumscribed.

A skilled person will understand that 'substantially spherical' may also include a cylindrical shape with smoothed edges, as long as the cylinder has a length vs diameter ratio of around 1, preferably between 0.6 and 2 or between 0.8 and 1.5.

The granules have a substantially homogeneous density, in the sense that they are solid and not hollow. However, the granules may include a plurality of gas bubbles, established e.g. by foaming.

It will be understood that the volumes of materials used in constructing a full-sized sports field require that the infill is relatively cheap to produce. Preferably it can also be made of recycled materials and can itself be recycled. Certain thermoplastics have already been extensively used in this context e.g. for artificial grass fibre manufacture and their further use as granules may be preferred. The material for the granules may be selected from the group comprising: polyethylene (PE, LDPE, LLDPE, MDPE, HDPE), polypropylene (PP), polyamides (PA), polyurethane PU), polystyrene (PS), expanded polystyrene (EPS), polycarbonate (PC), polyethylene terephthalate (PET), polyethylene isosorbide terephthalate (PEIT), polyethylene furanoate (PEF), polyhydroxy alkanoates (PHA), polylactic acid (PLA), acrylonitrile butadiene styrene (ABS) polybutylene succinate (PBS), polybutylene adipate co-terephthalate (PBAT), polybutylene terephthalate (PBT), polycaprolactone (PCL), phenol formaldehyde (PF) polypropylene carbonate (PPC), polytrimethylene terephthalate (PTT), polyvinyl chloride (PVC), polyvinyl alcohol (PVOH), thermoplastic starch (TPS) and derivatives and combinations of the above. Of these, PE, PP, PA, PU, PS, ABS, PC, PET, PEF, PHA and PLA are considered particularly promising candidates.

According to an embodiment, the granules may have a bulk density of between 0.1 kg/litre and 0.5 kg/litre, preferably between 0.2 kg/litre and 0.4 kg/litre and more specifically between 0.25 kg/litre and 0.35 kg/litre. It will be understood that the polymers mentioned above have specific densities that are generally much higher than these values although the bulk densities of granulates of the requisite size will approach the upper end of these ranges. Foamed granules may be used to reduce the specific density of the material and thus its bulk density. This will also help reduce the overall material cost. Foaming may be achieved by the introduction of blowing agents during the production process including both exothermic and endothermic processes and chemical or physical blowing agents. Preferably foaming takes place using carbon dioxide. The foamed granule may be open celled or closed celled although a closed celled granule may be preferred. The mentioned density values may be chosen as a compromise between economic and structural properties. Additionally, the mentioned bulk densities may promote better mixing of the granules with the cork particulates.

The granules may be homogenous in structure or may comprise mixtures of materials. Thermoplastic material may be combined with a filler such as chalk or the like, which may be for the purpose of reducing cost or adjusting specific density or other characteristics of the granules. In another embodiment, the granules may have a thermoplastic outer surface coated onto a non-thermoplastic core.

According to an embodiment, the granules may have a size which is larger than the mean particulate size of the soft infill. In general, the size distribution of the cork particulates may be substantially normal. The granule size may be chosen such that at least 50% of the cork particulates are smaller than the granules. This may improve mixing of the different materials. The granules may have a mean size of between 1 mm and 5 mm, preferably between 1.5 mm and 2.5 mm and most preferably between 1.5 mm and 2 mm. The skilled person will understand that although reference is given to the mean size of the particulates and granules, a number of different procedures may be used to determine these sizes. In the present context, this value is given according to ASTM C136/C136M-14 "Standard Test Method for Sieve Analysis of Fine and Coarse Aggregates". These test procedures use D10 and D90 values to define the respective number of particles within the range, whereby 10% of particles may be below the D10 value and 90% of particles will be below the D90 value. For the granules , the D10 and D90 values may lie within 30% of the mean size. Preferably the granules are more tightly sized and the D10 and D90 values may lie within 20% of the mean size or even within 10% of the mean size. The cork particulates may have a wider spread, represented by D10 and D90 values that may be 30% distanced from the mean value or even more.

According to an embodiment, the specific density of the granules is at least 20% larger than specific density of the soft infill. A separated specific density makes it possible to separate the two materials at the end of life of the artificial turf system, which promotes recycling. Separation based on specific density can be done by means of floating, cyclones or other methods known to the skilled person.

According to the invention, the granules are both smooth and hard. Preferably, the granules are made of a material that has a surface hardness of greater than Shore D 40. In general, the Shore A hardness scale is used for defining the hardness of rubbers and elastomers. The material chosen for the granules may be beyond the Shore A scale or at least above Shore A 90. The Shore D scale is more appropriate for determining the hardness of thermoplastic materials used as granules and a value of Shore D of 40 may be seen as a minimum. More preferably, the granules may have a surface hardness greater than Shore D 45, or even greater than Shore D 50. In fact much harder materials, more frequently measured on the Rockwell R scale of hardness may even be used e.g. having Rockwell R hardness of greater than 20 and including ceramics, stone, silica and metals. Although reference is given to the hardness, it will be understood that the crush strength of the granules is also important and they should not be subject to crumbling or breakage during normal use.

The invention further relates to an artificial turf system including an artificial grass layer comprising a substrate and pile fibres upstanding from the substrate; an infill layer, the infill layer comprising the infill mixture as described herein, disposed on the substrate and interspersed between the pile fibres. In addition to the infill mixture described, there may be additional infill in the form of a stabilising layer such as sand, placed beneath the infill mixture. Furthermore, the artificial turf system may comprise a shock pad or other form of resilient layer beneath the substrate.

The infill layer can be present at a depth that is sufficient to adequately support the pile fibres over a substantial portion of their length and will depend on the length of these fibres and the desired free pile. In a preferred embodiment, the infill layer has a depth of at least 10 mm. This may correspond to at least the depth of a typical stud being used for the intended sport. In other embodiments, the infill layer may be present to a depth of at least 20 mm or even to a depth of greater than 30 mm. It will be understood that the final depth will also depend upon whether the infill layer is the only layer on the substrate supporting the pile fibres and if a shock pad or other form of resilient layer is applied. Depending on the nature of the sport, the pile fibres may extend at least 10 mm or at least 15 mm or even more than 20 mm above the level of the infill.

The invention further relates to smooth, hard granules for avoiding compaction of an infill layer of an artificial turf system, the artificial turf system comprising a substrate underneath the infill layer and pile fibres upstanding from the substrate, wherein the infill layer comprises a predominance of cork particulates, and wherein the granules are made of a foamed material.

The infill layer may additionally or alternatively comprise styrene-butadiene (SBR), thermoplastic elastomers (TPE), ethylene propylene diene monomers (EPDM), Holo™, or comparable alternatives.

The invention further relates to a method for avoiding compaction of an infill layer of an artificial turf system, the artificial turf system comprising a substrate underneath the infill layer and pile fibres upstanding from the substrate, the method comprising mixing the smooth, hard granules into the infill prior to or subsequent to distributing the infill over the substrate.

While for a new installation, mixing of the granules with the particulates of the infill may take place prior to distributing the infill, there may be situations where a renovation of an existing field is required. This may comprise raking or otherwise disturbing the existing infill layer and mixing in the smooth hard granules in the requisite quantity.

The invention further relates to the use of the infill mixture as described herein in an artificial turf system.

The invention further relates to the use of the infill mixture as described herein in the construction of a pitch for field hockey, football, American football or rugby.

BRIEF DESCRIPTION OF THE DRAWINGS

The features and advantages of the invention will be appreciated upon reference to the following FIGURE, which shows a cross-section through an artificial turf system according to an embodiment of the present invention.

DESCRIPTION OF ILLUSTRATIVE EMBODIMENTS

EXAMPLE 1

The FIGURE shows a cross-section through an artificial turf system 10 according to an embodiment of the present invention. The turf system 10, comprises a stabilised sub-base 12, a resilient layer 13, a woven artificial turf substrate 14 having upstanding pile fibres 16, a stabilising sand layer 17 and an infill layer 18,19. The turf substrate 14 was a woven carpet MX Elite 50 from Greenfields with 50 mm Trimension fibres. The stabilising sand layer 17 was 10 mm thick Filcom sand graded 0.5-1.0 mm with a coverage of 22.4 kg/m$^2$. The resilient layer was a 10 mm layer of HP XC 050010 from Trocellen™. The infill layer consisted of cork (Amorim) particles 18 with a size range of 0.5 mm-2.5 mm, a bulk density of 0.12 kg/litre and a coverage of 1.3 kg/m$^2$, mixed with smooth, hard PE granules 19 with a size range of 1 mm-1.6 mm, a bulk density of 0.29 kg/litre and a coverage of 2.0 kg/m$^2$. The mixing ratio was 60/40 vol % of cork/PE granules.

Tests Using Lisport XL

The system of Example 1 was subject to several tests using a Lisport™ XL machine. Lisport XL is a wear simulation machine replicating realistically wear simulation of sport fields after years of usage. The wear pattern is characterised by the compressive stress of football studs (cleats) and the abrasive wear caused by flat-soled sports shoes. In this test, fields are subject to rollers with studs, which roll back and forth over the field. More information on the test can be found in the FIFA Handbook of Test Methods (https://football-technology.fifa.com/en/media-tiles/football-turf-handbook-of-test-methods-2015/). Lisport XL is described in Appendix I, page 70.

After a number of cycles of the Lisport XL machine, the ball bounce and rotational friction are measured at five separate locations and the averaged result compared to international standards defined by FIFA Quality Pro, FIFA Quality and IRB (International Rugby Board). The results can be found below.

| No. Cycles | Ball Bounce (cm) | Rotational Friction (N/m) | FIFA Quality Pro | FIFA Quality | IRB |
|---|---|---|---|---|---|
| 5 | 72.1 | 36.4 | Yes | Yes | Yes |
| 3005 | 84.4 | 41.8 | Yes | Yes | Yes |
| 6005 | 89.4 | 46.0 | No | Yes | Yes |
| 9005 | 90.4 | 48.0 | No | Yes | Yes |

Additionally, the shock absorption, vertical deformation, and ball roll were measured:

| No. Cycles | Shock absorption (%) | Vertical deformation (mm) | Ball roll up (m) | Ball roll down (m) |
|---|---|---|---|---|
| 5 | 66.7 | 10.1 | 7.11 | 5.50 |
| 3005 | 62.8 | 9.1 | 5.88 | 5.78 |
| 6005 | 63.3 | 9.0 | 6.30 | 7.20 |
| 9005 | 61.2 | 8.8 | 5.76 | 6.31 |

All of the measured parameters, except for the vertical deformation after 5 cycles, complied with the international standards as defined above.

The test results above illustrate that the system of Example 1 represents a system which barely suffers from compacting, even after more than 9000 cycles of Lisport XL, as indicated by the measured ball bounce, shock absorption and ball roll. Importantly, these results were achievable without requiring raking or otherwise agitation of the surface. In this context, it may be noted that the Lisport XL test allows and requires light raking of the surface before testing. Conventional infill requires such raking on a regular basis to offset compaction of the infill. In the case of the infill mixture according to the invention, little compaction was observed and raking was not even required.

In addition to the disclosed example described in relation to Example 1, the skilled person will understand that many other configuration may be considered, which will equally fall within the scope of the present claims.

Many further modifications in addition to those described above may be made to the structures and techniques described herein without departing from the spirit and scope of the invention. Accordingly, although specific embodiments have been described, these are examples only and are not limiting upon the scope of the invention.

The invention claimed is:

1. A method for avoiding compaction of cork particulates in an infill layer comprising:

mixing an infill comprising cork particulates and smooth hard granules, wherein the cork particulates make up 51-70% of the infill , and the granules make up 49-30% of the infill, and a percentage of the particulates is complementary to a percentage of the granules, and distributing the infill in an artificial turf system having a substrate and a plurality of pile fibers extending from the substrate, wherein the step of distributing the infill includes creating an infill layer over the substrate so that the pile fibers extend above the infill layer, wherein a surface of the granules has a static frictional coefficient less than 0.5 and a surface hardness greater than Shore D 40, wherein the granules have a mean size which is larger than the mean particulate size of the cork particulates, and wherein the granules have a sphericity of greater than 0.9.

2. The method of claim 1, wherein the cork particulates have a mean size between 0.5 and 3 mm and at least 50% of the cork particulates are smaller than the granules.

3. The method of claim 1, wherein the cork particulates have irregular shapes.

4. The method of claim 1, wherein the infill mixture comprises about 60 vol % of cork particulates and about 40 vol % of the granules.

5. The method of claim 1, wherein the granules comprise a thermoplastic material, selected from the group comprising: PE, PP, PA, PU, PS, ABS, PC, PET, PEF, PHA and PLA.

6. The method of claim 1, wherein the granules are made of a closed-cell foamed material.

7. The method of claim 1, wherein the granules have a bulk density of between 0.1 kg/liter and 0.5 kg/liter.

8. The method of claim 1, wherein the granules have a mean size between 1 and 5 mm.

9. The method of claim 1, further comprising separating the granules and the cork particulates at an end of life of the artificial turf system, wherein the specific density of the granules is at least 20% larger than the specific density of the cork particulates.

10. The method of claim 1, wherein the material of the granules has a hardness of at least Shore D 45.

11. The method of claim 1, wherein the artificial turf system is part of a pitch for field hockey, association football, American football or rugby.

12. An artificial turf system, comprising:

an artificial grass layer comprising a substrate and pile fibers upstanding from the substrate;

an infill layer, disposed on the substrate and interspersed between the pile fibers, the infill layer consisting of cork particulates; and a cork particulate based infill mixture configured to prevent compaction of the cork particulates, comprising cork particulates, and smooth, hard granules, wherein the cork particulates make up 51-70% of the infill mixture, and the granules make up 49-30% of the infill, and a percentage of the particulates is complementary to a percentage of the granules, and the granules have a mean size larger than a mean size of the cork particulates, wherein the granules have a surface having a static frictional coefficient less than 0.5, a surface hardness is greater than Shore D 40, and a sphericity of greater than 0.9.

13. The artificial turf system of claim 12, wherein the infill layer has a depth of at least 20 mm.

14. The artificial turf system of claim 12, wherein a ball bounce height is less than 100 cm after 9000 cycles of the LisportXL test.

15. The artificial turf system of claim 12, wherein the artificial turf system is part of a pitch for field hockey, association football, American football or rugby.

16. An infill mixture for preventing compaction of an infill layer of an artificial turf system, the artificial turf system comprising a substrate underneath the infill layer and pile fibers upstanding from the substrate, wherein the infill mixture consists of cork particulates and smooth, hard granules wherein the cork particulates are 51% of the infill mixture, wherein the granules have a roundness of greater than 0.9.

17. The infill mixture of claim 16, wherein:

the infill mixture comprises between 70 vol % and 51 vol % of cork particulates and between 30 vol % and 49 vol % of the granules;

the cork particulates have a mean size between 0.5 mm and 3 mm;

the cork particulates have irregular shapes relative to the granules, which have substantially spherical shapes;

the granules have a mean size which is larger than the mean particulate size of the cork particulates;

the specific density of the granules is at least 20% larger than the specific density of the cork; and the material of the granules has a hardness of at least Shore D 40.

18. The infill mixture of claim 16, wherein the granules have a first mean size and a first size distribution, wherein D10 and D90 values of the first size distribution lie within 10% of the first mean size; and wherein the cork particulates have a second mean size and a second size distribution such that D10 and D90 values of the second size distribution are more than 30% distanced from the second mean size.

* * * * *